United States Patent [19]

Burton

[11] Patent Number: 4,911,212

[45] Date of Patent: Mar. 27, 1990

[54] BOTTLE FILLING DEVICE

[76] Inventor: John W. Burton, #4 Woodland Dr., Pittsburgh, Pa. 15228

[21] Appl. No.: 211,709

[22] Filed: Jun. 27, 1988

Related U.S. Application Data

[63] Continuation-in-part of Ser. No. 69,845, Jul. 6, 1987, abandoned.

[51] Int. Cl.[4] ..... B65B 43/42; B65B 63/08

[52] U.S. Cl. ..... 141/369; 141/18; 141/90; 141/94; 141/98; 141/104; 141/105; 141/82; 141/165; 141/378; 222/146.6; 222/129.1; 261/DIG. 7; 426/477; 99/323.1

[58] Field of Search ..... 141/100, 104–107, 141/98, 2, 4, 18, 97, 82, 165, 251, 263, 269, 312, 369, 370, 378, 89, 85, 90, 91–96; 99/275, 323.1, 323.2; 261/112.1, D7; 426/477; 222/2, 129, 129.1, 130, 131, 132, 135, 146.6; 250/455.1, 492.1, 504 R, ; 134/166 R

[56] References Cited

U.S. PATENT DOCUMENTS

| | | | |
|---|---|---|---|
| 755,600 | 3/1904 | Carlson | 222/129.2 |
| 1,442,405 | 1/1923 | Hawthorne | 222/133 X |
| 1,984,457 | 12/1934 | Buttolph | 250/455.1 |
| 2,175,682 | 10/1939 | Chaffee | 141/150 X |
| 2,261,338 | 11/1941 | Carlson | 222/144.5 |
| 2,653,733 | 9/1953 | Rudd et al. | 222/148 |
| 2,838,077 | 6/1958 | Cooper | 141/93 |
| 3,090,293 | 5/1963 | Plock et al. | 99/323.3 X |
| 3,259,273 | 7/1966 | Kromer | 222/145 X |
| 3,599,833 | 8/1971 | Reichenberger | 222/23 |
| 3,638,392 | 2/1972 | Welker, Jr. et al. | 141/104 X |
| 3,856,059 | 12/1974 | Hartness et al. | 141/165 |
| 3,912,535 | 10/1975 | Rauser | 141/91 X |
| 4,164,964 | 8/1979 | Daniels | 141/329 |
| 4,191,183 | 3/1980 | Mendelson | 141/107 X |
| 4,304,741 | 12/1981 | Avison et al. | 261/DIG. 7 |
| 4,342,710 | 8/1982 | Adolfsson et al. | 261/121.1 |
| 4,530,202 | 7/1985 | Powell et al. | 141/90 X |
| 4,574,850 | 3/1986 | Davis | 141/9 |
| 4,731,541 | 3/1988 | Shoemaker | 250/504 R |
| 4,753,277 | 6/1988 | Holcomb et al. | 141/95 |

*Primary Examiner*—Ernest G. Cusick

*Attorney, Agent, or Firm*—Buchanan Ingersoll; Lynn J. Alstadt

[57] ABSTRACT

A bottle filling machine is disclosed in which a chamber is provided for receipt of a refillable bottle with a resealable opening through which a probe may extend. Centering means extend into the housing to center the bottle on the base of a chamber. Then a probe extends into the chamber and engages an opening in the refillable bottle to fill and pressurize the bottle. After filling, the probe retracts allowing the filled bottle to be removed from the chamber.

23 Claims, 4 Drawing Sheets

Fig. 4.
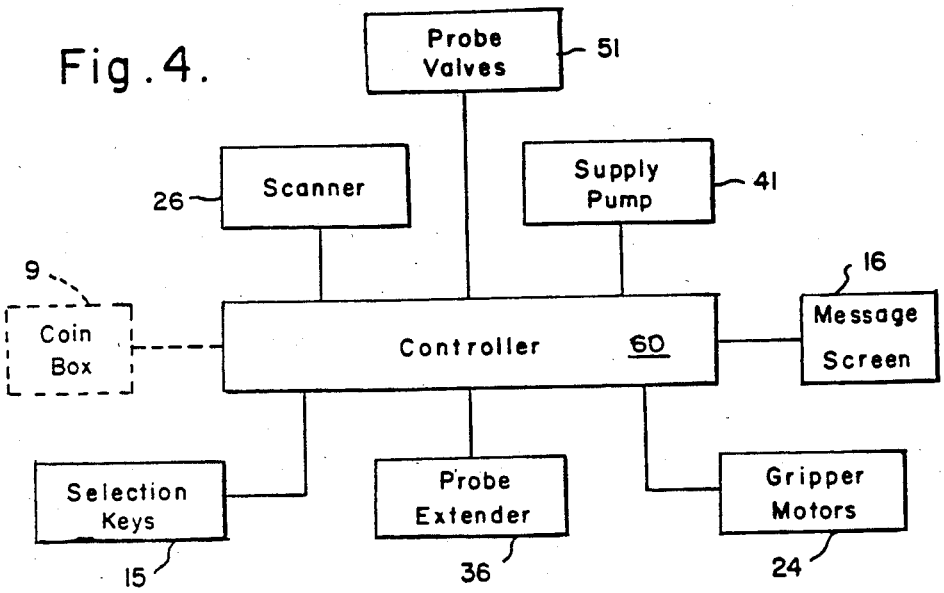
Fig. 3.
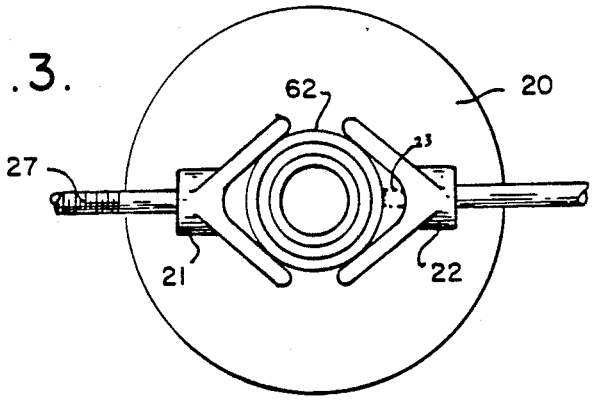
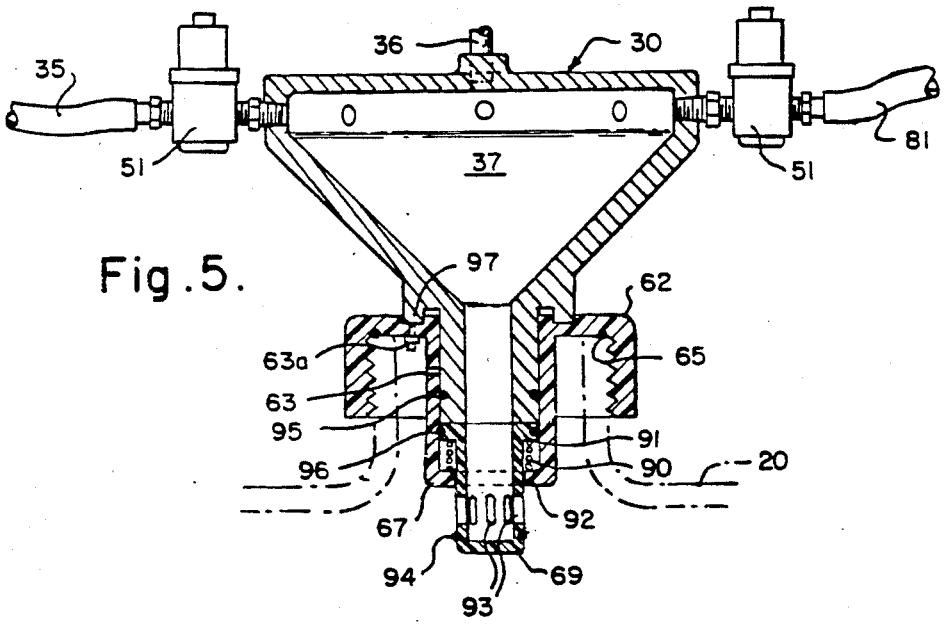
Fig. 5.

BOTTLE FILLING DEVICE

CROSS REFERENCE TO RELATED APPLICATION

This application is a continuation-in-part of my copending application Ser. No. 069,845, filed July 6, 1987 now abandoned.

FIELD OF INVENTION

The present invention relates to a new and useful form of a bottle filling device for filling refillable bottles which carbonated beverages and other liquids under pressure.

BACKGROUND OF THE INVENTION

A number of bottle filling devices have been developed for filling refillable bottles with liquids. Some of those devices also pressurize the bottle before capping it. The prior art bottle filling devices are generally large and designed for production line operation in a factory. They must be operated by trained operators and are generally quite expensive. The art has not developed an automatic bottle filling machine which can be operated by the consumer at the point of retail purchase.

A variety of vending machines have been developed which sell liquids in bottles, cans and cups. The bottles and cans offered by these machines are filled at the factory and are usually disposable. The cups offered by other vending machines are intended for a single use. Consequently, a purchaser who uses these vending machines must pay not only for the liquid he wishes to consume, but also for the non-reusable package in which it is contained. There is a need for a vending type machine which can be used to fill reusable bottles inserted into the machine by the purchaser. A vending machine which utilizes containers inserted into the machine by the purchaser enables the product, and components from which the product can be made, to be transported and stored by the supplier in bulk quantities until purchased by the consumer. For many products, particularly those containing water, product components can be combined at the point of retail sale to manufacture the product. For carbonated and uncarbonated soft drinks, this eliminates the packaging, warehousing, transporting and shelf storage of water which can be supplied to my filling machine at the retail point of purchase and there mixed with flavor syrup. It also eliminates the need for providing and charging for packaging.

One potential problem with the creation of a vending machine which can fill bottles supplied by the purchaser is the lack of a suitable, refillable liquid container that could be easily filled in a vending machine. Present refillable bottles have removable caps. Although these caps can be placed by machine onto the bottle, the capping process requires a large mechanism which is impractical for a vending machine environment. Bottles which have been uncapped by the user cannot be completely resealed. Unless the bottle is completely sealed, the product may deteriorate and carbonation will be lost. I have developed a refillable bottle described in my U.S. patent application Ser. No. 029,167, filed Mar. 23, 1987, which overcomes the problems of prior art bottles and is particularly suited for my filling machine.

SUMMARY OF THE INVENTION

The present invention provides a vending-type machine for refilling bottles with a selected liquid. The machine has one or more chambers into which the bottle is placed by the consumer. A single machine may have chambers having different sizes to receive various sizes of bottles. A gripping mechanism extends from either side of the chamber to grip the bottle and center it in the chamber under the filling probe. I prefer to provide a particular size or configuration of bottle which will enable the gripper to identify the bottle as being appropriate for the selected filling operation. The bottle has a resealable opening on its top through which a probe may fit. Once the bottle is in place, the probe extends into the chamber and passes through the resealable opening of the bottle. The probe has several supply tubes connected to it through which one may vacuum, fill with liquid, color, flavor or other additives and pressurize the bottle to a desired pressure with a gas of choice. I prefer to follow a sequence in which a probe is inserted into the bottle and then a vacuum is drawn to remove most air remaining in the bottle. If one uses a bottle which is vented to allow air to escape during filling, it is not necessary to vacuum the bottle prior to filling. Next, the bottle is filled to preferably two-thirds of its volume with the chosen liquid, color and flavor. Then a gas is injected into the bottle to pressurize it. Thereafter, the probe and grippers are removed completing the filling cycle.

BRIEF DESCRIPTION OF THE DRAWINGS

FIG. 3 is a top plan view of a bottle with which grippers are engaged;

FIG. 4 is a block diagram of a preferred electrical circuit for the filling machine;

FIG. 5 is a detailed sectional view of my preferred bottle filling probe and top portion of the bottle being filled;

DESCRIPTION OF THE PREFERRED EMBODIMENTS

Figure 1:
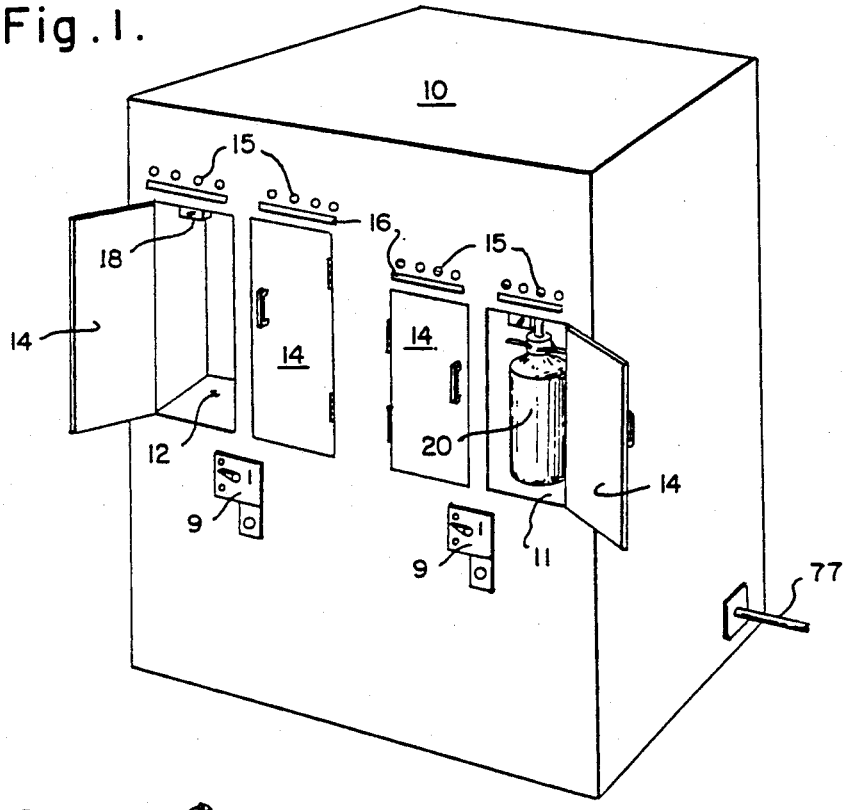
FIG. 1 is a perspective view of a present preferred embodiment of my filling machine.

Referring to FIG. 1, I provide a vending machine having a cabinet 10 in which there are one or more chambers 11 and 12 for receipt of a bottle. The chambers may be sized to receive a specific size bottle. The embodiment of FIG. 1 has two chambers 11 which will accomodate two liter bottles and two chambers 12 for six liter bottles and eight liter bottles. However, my machine can be made with any number of chambers sized to accomodate any size bottle. These chambers preferably have doors 14 which can be closed during the filling operation. A safety switch 18 may be provided which will stop the filling operation if the door 14 is opened.

If the machine is located in a retail store, a switch can be provided to activate the machine. That switch could be placed on the outside of the machine and operated by the user or it could be positioned in chambers 11 and 12 and activated when a bottle is placed in the chamber. Alternatively one could provide for the machine to activate when a product selection key 15 is pressed. Those machines which are located outside of a retail store may have a coin box 9. The user makes payment through the coin box 9 and inserts a bottle 20 into one of the chambers. If a single product is being dispensed and a coin box is used, the coin box could activate the machine when the proper payment is made. In this instance, the coin box could function as the selection key.

Reference should be made to FIGS. 2 thru 7 to understand the filling operation. After the door 14 is closed centering means such as grippers 21 and 22 extend into the chamber to engage the bottle, center it on base 19 and hold it in place. A simple servo motor 24 for each gripper can be used to move the grippers in and out. Some means should be provided to identify the bottle in the chamber to assure that it is suitable for filling. I prefer to provide markings 27 on at least one gripper which can be read by optical scanner 26. The scanner will tell a controller that the grippers are extended and how far they have moved. Another option is to provide a microswitch 23, shown in chain line in FIG. 3, which engages the bottle cap 62 when the grippers are fully extended. Bottle 20 has a cap of a chosen size, diameter, height or configuration which identifies a product which may be put into the bottle. Thus, the position of the grippers will indicate the type of bottle in the chamber. Other identification means could be used. For example, an optical scanner may read a code or other marking on the bottle. Another alternative is a mechanical counter which measures movement of the grippers. Yet, another means is to provide scanners which measure height and diameter or height-diameter relationships. The information read by the scanner 26 is transmitted to a controller 60. Although I prefer to provide movable grippers to align and hold the bottle 20 for the probe 30, one could also use fixed centering means such as a cavity in the base 19 of the chamber. Alternatively, grippers 21 and 22 could be fully extended and sized to allow the bottle to be fitted between them and in that position be aligned with probe 30.

Figure 2:
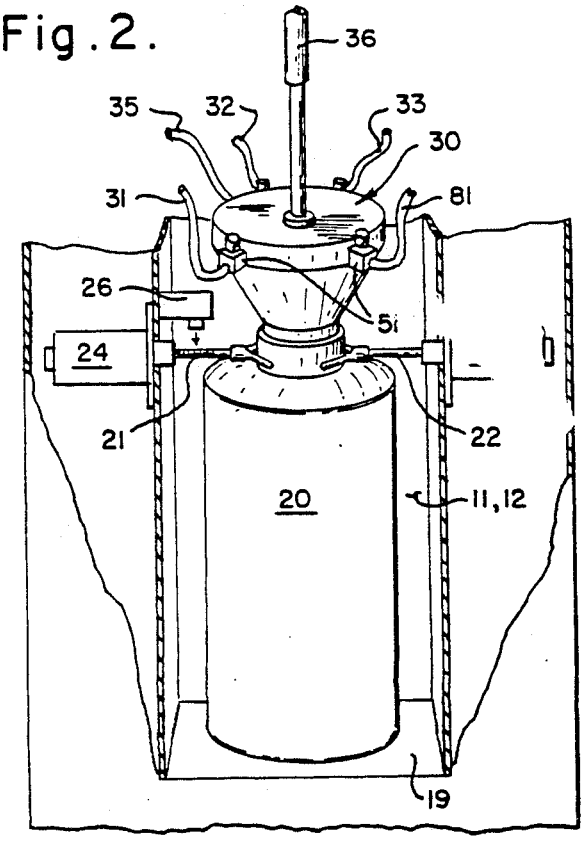
FIG. 2 is a perspective view of the interior of a bottle filling chamber showing a filling probe engaging the bottle.
Figure 7:
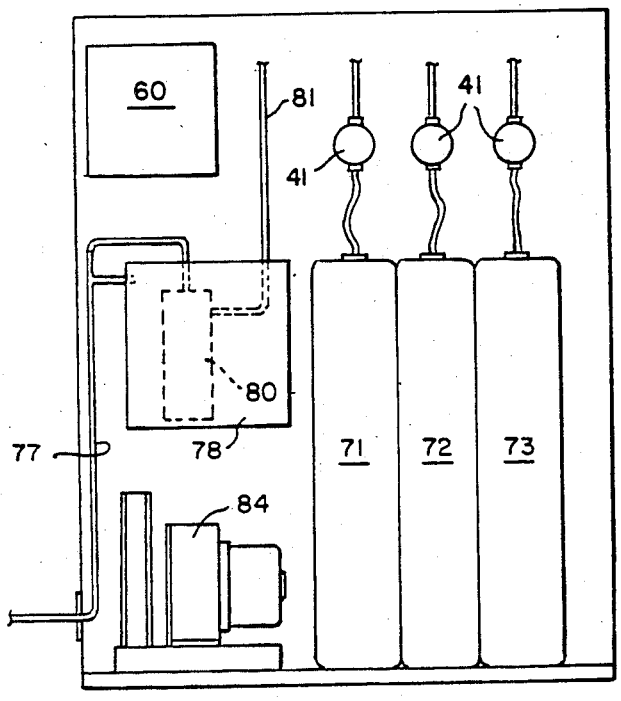
FIG. 7 is a sectional view taken along the lines VII—VII of FIG. 6.
Figure 6:
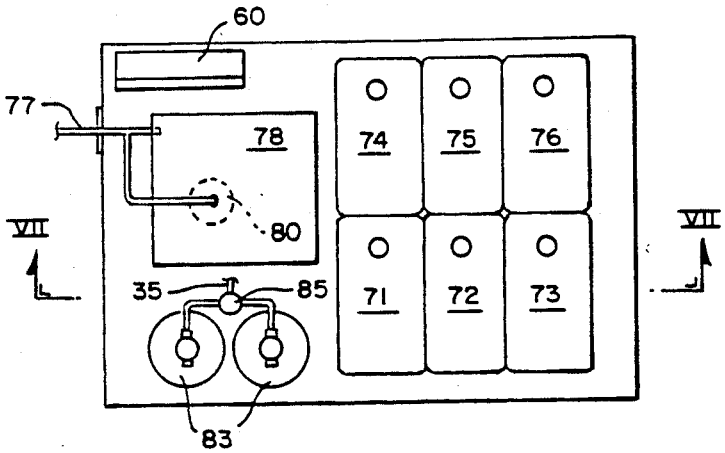
FIG. 6 is a schematic top plan view of the interior of my filling machine in which the probes and chambers are not shown.

After the user pushes a selector key 15 (see FIG. 1) on the housing the controller 60 receives the selection and compares it to the type of bottle in the chamber. If the correct bottle is in the chamber for the material selected, the filling operation proceeds. Otherwise, the controller will activate a message screen 16 on the housing telling the consumer that he has made an improper selection. Once the bottle has been secured and an appropriate selection has been made, a probe 30 is extended by extension means 36 from the top of the chamber into a resealable opening in the bottle 20. A pneumatic cylinder, electric motor or other electro-mechanical device, may be used as extension means for raising and lowering the probe into the bottle. As shown in FIG. 2, the probe preferably has several ports into which are connected supply tubes 31, 32, 33, 35 and 81. The tubes in turn run to supply pumps connected to supply containers 71 thru 76 or to a vacuum system and gas supplies of choice. I prefer to provide valves 51 where each supply tube enters probe 30. These valves are connected to a controller 60 which selectively opens and closes the valves to allow the proper fluid to enter the bottle 20. If the amount of fluid is not determined by the supply pump, valves 51 could be used to determine the nature and amount of fluid going into the bottle. My machine can be used to dispense any liquid, paste, powder or other fluid which can be carried and dispensed from a pressurized container. This includes beverage products, household cleaning products, spray paints, cosmetics, foods and chemicals. The supply tubes are connected to one or more supply pumps 41 shown in FIG. 7. in a vending machine for carbonated beverages flavor tanks 71, 72, 73, 74, 75 and 76 and a carbonator 80 in a cold water bath 78 are provided. A separate supply pump is connected to each flavor tank 71 thru 76. Alternatively, the flavor tanks could be pressurized prior to installation or with a pressuring pump in the machine. In this situation flavor would flow into the probe whenever the valve 51 in a supply line is open.

For machines which dispense products other than carbonated beverages the supply tanks would contain one or more base fluids and modifiers such as coloring, seasoning, thickening, detergents or other additives. I prefer to provide a supply line 77 (FIGS. 1, 6 and 7) running from an outside source of water to an internal chilling and cooling bath 78. Supply line 77 also supplies carbonator 80. Carbon dioxide tanks 83 supply carbon dioxide gas to the carbonator 80 through a supply hose (not shown) and supply gas for pressurizing bottles after filling through gas pump or regulator 85 and supply line 35. The carbonator 80 is connected through supply line 81 to probe 30. I also prefer to provide a refrigeration unit 84 for cooling water bath 78. This unit could also cool flavor tanks 71 thru 76 and the supply line to probe 30.

As shown by the block diagram of FIG. 4, the entire operation of my machine is operated by a controller 60. This is a microprocessor which is programed to receive information from the selection keys 15, message screen 16, optional coin box 9, safety switch 18 and scanner 26 and activate the gripper motors 24, probe extender 36, probe valves 51 and supply pumps 41 to fill the bottle 20. Any number of probe valves and supply tanks can be used. The probe valves could be operated individually or in combination depending on the product being dispensed. For clarity, I have not shown wires running from controller 60 to these components. However, it should be apparent to those skilled in the art that all electrical components of my filling machine are wired to and controlled by controller 60.

After the bottle 20 has been positioned by grippers 21 and 22 and probe 30 has engaged the bottle, filling beings. The filling sequence will vary according to the material which is injected into the bottle and whether the bottle or the probe is vented. If bottle 20 and probe 30 are not vented, I prefer to also connect tube 35 to a vacuum pump (not shown) which evacuates the bottle creating an internal air pressure below atmospheric pressure. Alternatively, one could use a vented bottle or vented probe which eliminates the need for removing air from the bottle prior to filling.

After any required vacuuming of the bottle to remove most gas from it, I fill the bottle to preferably two-thirds of its volume with a chosen liquid, color and flavor. Then I inject a gas, preferably nitrogen, into the bottle to pressurize it. The bottle is now filled and the probe and grippers retract to complete the filling cycle.

In FIG. 5, I have shown a cross-sectional view of my filler probe engaged with the top of a vented bottle 20. Bottle 20 has a cap 62 with a valve arrangement and optional vents 63 and **63*a* which could also be used to draw a vacuum. Vent 63*a* is a conventional tire type valve activated when engaged by the probe 30. The cap 62, which can be made of metal or plastic, is preferably molded of plastic to have inner threads which mate with threads on the mouth of the bottle. I also prefer to provide an O-ring seal 65 in the cap which seals any gap between the cap and the mouth of the bottle. Within the cap there is a valve. This valve has a generally cylindrical outer housing 67. Within housing 67 is a basket 69 which rests on a spring 90. This spring is positioned between upper rim 91 of basket 69 and shoulder 92. The basket is closed at its bottom, but has a plurality of slots 93 in the side wall. The valve is operated by inserting a probe 30 which pushes basket 69 into bottle 20. When the probe is removed, the basket returns to its original position. An exterior seal 94 is provided on the lower portion of the basket 69. If one incorporates a vent valve 63 in the cap it should be apparent that the position of probe 30 and seals 95 and 96 will determine if air can pass through the vent valve 63. Seal 95 mates with the inner surface of the valve to prevent liquid from flowing around the outside of the probe. A shoulder 97 is provided on the probe for proper engagement of the bottle and vent valve 63*a***.

During filling any air in a vented bottle will escape through a vent or vents 63 or **63*a* in the bottle. After being filled with the selected product, the bottle is pressurized through supply tube 35 by the injection of a gas such as nitrogen, carbon dioxide, aerosol propellant, or another gas which is more suitable for the specific liquid. The gas should flush all carbonated water and flavor from the probe into the bottle. I also prefer to use carbon dioxide or nitrogen and to fill the bottles two-thirds full of liquid and one-third full of gas. After the bottle 20 has been filled and pressurized the probe extender 36 lifts the probe 30 from the bottle 20 to a position above chamber 10. Then gripper motors 24 are energized to retract the grippers. That completes the filling cycle and bottle 20** may be removed by the customer.

For carbonated beverages I prefer to use the sequencing just described which begins with drawing a vacuum. The mixing chamber 37 allows flavor and carbonated water to be injected simultaneously and mix before entering the bottle. Because of its conical shape any flavor or pigment in the probe will be purged when base fluid and gas flow through the probe.

Figure 8:
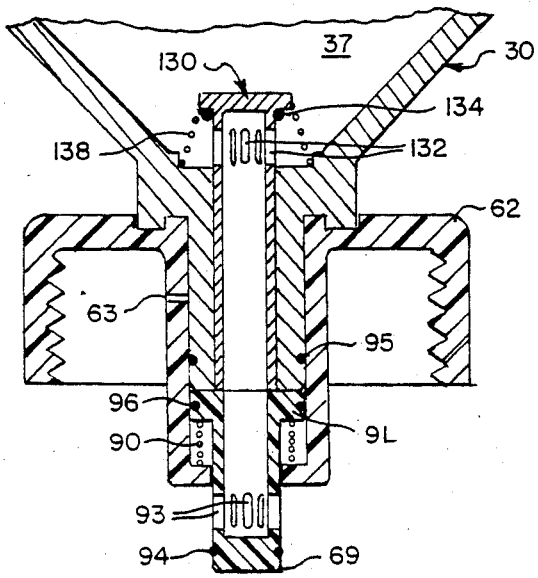
FIG. 8 is an elevational view partially in section showing my probe with a spring loaded shutoff valve.

The probe for the filling machine may be provided with a spring-loaded shut-off valve as shown in FIG. 8. Here the mixing nozzle 37 is fitted with a spring biased basket 130 having slots 132 and seal 134. When the probe 37 moves down to engage basket 69 of the bottle to be filled, basket 130 is forced into the probe. This allows fluid to pass from the mixing nozzle 37 through slots 132 into basket 130. The fluid exits the basket through opening 136 and enters the bottle through slots 93 of basket 69. When the probe 73 is lifted from the bottle, spring 138 pulls the basket out of the probe 73 until seal 134 engages the sides of the probe, closing and sealing the probe.

Figure 9:
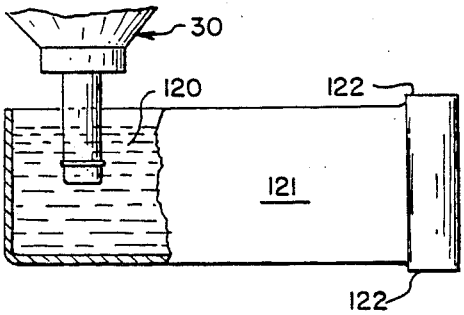
FIG. 9 is an elevational view of my probe in a sterilizing bath.

It may be desirable to provide means for sterilizing the probe. Several types of sterilization techniques can be used. As shown in FIG. 9, one could use a disinfecting bath 120. The bath is contained in a tub 121 which moves laterally or pivots around the edge 122. After filling a bottle, the probe 30 would be raised high enough to allow movement of tube 121 under the probe 30. When tub 121 is positioned under the probe 30, the probe is lowered into disinfecting bath 120 where it remains until the next filling operation. Then the probe 30 is raised out of the bath 120, tub 121 is retracted and probe 30 is extended to fill a bottle.

Figure 10:
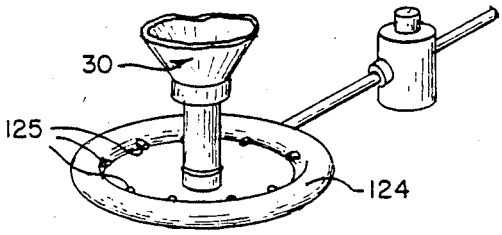
FIG. 10 is an elevational view of my probe positioned in a ring which emits a sterilizing gas.
Figure 11:
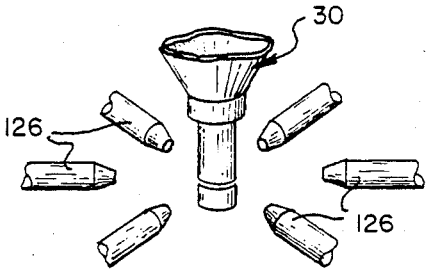
FIG. 11 is an elevational view of my probe with germicidal lamps around the probe.
Figure 12:
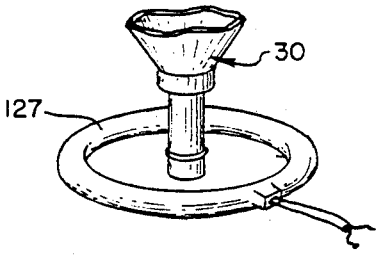
FIG. 12 is an elevational view of my probe encircled by a circular germicidal lamp.

Another sterilization technique uses a ring 124 which encircles probe 30. As shown in FIG. 10, the ring has a plurality of ports 125 through which steam or a disinfecting gas may be sprayed onto the probe. One could also use germicidal lamps 126 which encircle the probe 30 as shown in FIG. 11. One could use a plurality of lamps or a single tubular ring type bulb 127 shown in FIG. 12.

Figure 13:
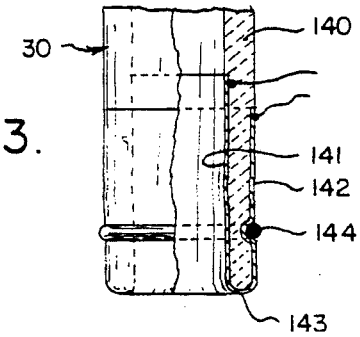
FIG. 13 is a fragmentary view of another present preferred embodiment of my probe having a ceramic core.

The probe could be designed for self sterilization. As shown in FIG. 13, probe 30 is constructed with a ceramic core 140 having a metallic coating on its interior 141, exterior 142 and distal end 143. Electrical leads 145 are connected to the interior 141 and exterior 142. The metallic coating then acts as a resistance element which can be heated to a temperature approaching 450° F. thereby providing high heat sterilization of the probe. When this embodiment is used, seal 144 must be made of a material which will not degrade when heated and the temperature of the probe must be controlled to avoid degradation of the seal. When the current is removed from the probe, it should cool rapidly.

Although my bottle filling machine is particularly useful for carbonated beverages, it can be used for any fluid including, but not limited to, fine powders, paints and other coatings, liquid foods, semi-solid foods, cooking liquids, perfumes, creams, liquid soaps and detergents, cosmetics, liquid waxes, paste products, insecticides, fertilizers, glue, mastics, lubricants, beer, wine, wine coolers and juices. These materials can be delivered to my machine in large drums or mobile supply tanks. Since the bottles for my machine are reusable and the product is transported and stored in bulk quantities, substantial savings over conventional product packaging and sale will result. These savings can be translated into higher profits for the vendor and lower costs for the consumer.

Although I have shown my device filling bottles in an upright position, it should be understood that the bottle could be oriented in any desired position. Indeed, for some applications it may be desirable to invert the bottle so that the amount of oxygen or other gas in the fluid contents of the bottle is reduced.

While I have shown several present preferred embodiments of the invention, it is to be distinctly understood that the invention is not limited thereto, but may be otherwise variously embodied within the scope of the following claims.

I claim:

1. A bottle filling machine comprising a. a housing;

b. a chamber within said housing having a base on which may be placed a refillable bottle having a top with a resealable opening through which a probe may extend;

c. centering means attached to the housing and positioned so that they may extend into the chamber to engage and center a bottle on the base;

d. a probe positioned within the housing so that it may extend into the chamber and engage the resealable opening in a refillable bottle on the base of the chamber to fill the bottle and then retract from the bottle, and having at least one opening to which at least one supply tube may be connected;

e. probe extender means attached to the housing and to the probe for extending and retracting the probe;

f. at least one fluid supply connected to said at least one opening of the probe and attached to the housing;

g. at least one selection key attached to the housing; and h. a controller within the housing and connected to said at least one selection key, said at least one fluid supply, probe extender means and centering means for selectively activating the centering means, probe extender means and said at least one fluid supply when at least one selection key is pressed.

2. The bottle filling machine of claim 1 wherein said at least one fluid supply includes at least one pump selected from the group comprised of a vacuum pump for drawing a vacuum through the probe, at least one liquid supply pump for pumping at least one selected liquid through the probe, and one of a gas pump and a gas regulator for supplying a gas through the probe to pressurize the bottle.

3. The bottle filling machine of claim 2 wherein the controller is programed to activate in sequence the vacuum pump, said at least one liquid supply pumps and one of the gas pump and gas regulator.

4. The bottle filling machine of claim 2 also comprising at least one gas supply connected to one of the gas pump and the gas regulator.

5. The bottle filling machine of claim 4 wherein the gas supply is one of carbon dioxide, nitrogen, aerosol propellant and a mixture of carbon dioxide and nitrogen.

6. The bottle filling machine of claim 1 also comprising gauge means connected to the controller for determining the orientation of the centering means after it has engaged a bottle in the chamber.

7. The bottle filling machine of claim 6 wherein the gauge means is an optical scanner positioned to read markings on for centering means, and the centering means has markings thereon which may be read by the optical scanner.

8. The bottle filling machine of claim 7 wherein the controller is programed to compare the markings read by the optical scanner with said at least one selection key activated to determine if the bottle engaged by the centering means is appropriate to receive the material chosen by the activated selector key.

9. The bottle filling machine of claim 1 also comprising at least one valve attached to said at least one supply tube opening of the probe and connected to the controller in a manner so that the controller may open and close the valve.

10. The bottle filling machine of claim 1 also comprising at least one pressurized fluid supply tank connected to the probe.

11. The bottle filling machine of claim 1 wherein the probe is comprised of a mixing chamber having radially arranged supply tube openings and a rigid tube extending from the mixing chamber which is sized and positioned to engage a bottle.

12. The bottle filling machine of claim 11 wherein the mixing chamber is conical.

13. The bottle filling machine of claim 1 also comprising at least one additional chamber within the housing, each chamber being sized to accomodate a different size bottle.

14. The bottle filling machine of claim 2 wherein the controller is programed to activate said at least one pump in a manner to fill a bottle two-thirds full of liquid and one-third full of a gas to a pressure sufficient to expel liquid contents when the bottle is opened.

15. The bottle filling machine of claim 1 wherein the centering means are positioned within the chamber in a fixed position and are sized so that a consumer may place a bottle against the centering means thereby placing the bottle in alignment with the probe.

16. The bottle filling machine of claim 1 also comprising a refrigerator unit positioned to cool said at least one fluid supply.

17. The bottle filling machine of claim 1 wherein the controller is programed to activate said at least one fluid supply, probe extender means and centering means after said at least one selection key is pressed in sequence as follows:

a. centering means engages and centers a bottle under the probe;

b. probe descends into the bottle through a resealable opening and seals to bottle;

c. any gas in the bottle is vented into the filling machine;

d. flavor syrup is injected into the bottle;

e. club soda is injected into the bottle in sufficient quantity to fill the bottle two-thirds full of flavor syrup and club soda;

f. gas is injected into the bottle to pressurize the bottle;

g. the probe is removed from the bottle; and h. the centering means releases the bottle.

18. The bottle filling machine of claim 1 wherein the controller is programed to activate said at least one fluid supply, probe extender means and centering means after said at least one selection key is pressed in sequence as follows:

a. centering means engages and centers a bottle under the probe;

b. probe descends into the bottle through a resealable opening and seals to bottle;

c. any gas in the bottle is vented into the filling machine;

d. at least one fluid is injected into the bottle in sufficient quantity to fill the bottle two-thirds full of fluid;

e. gas is injected into the bottle to pressurize the bottle;

f. the proe is removed from the bottle; and g. the centering means releases the bottle.

19. The filling machine of claim 18 wherein the sequence includes venting the bottle after the fluid is injected and before the gas is injected.

20. The bottle filling machine of claim 1 also comprising sterilization means attached to the housing for sterilizing the probe.

21. The bottle filling machine of claim 20 wherein the sterilization means is one of a sterilizing bath, a ring encircling the probe which emits sterilizing gas, an ultraviolet light and a resistant heating element attached to the probe.

22. The bottle filling machine of claim 1 wherein the probe is comprised of a ceramic core having a metallic coating and electrical leads connected to the coating.

23. The bottle filling machine of claim 1 comprising a microswitch connected to the centering means in a manner to engage a bottle when the centering means touches the bottle.

* * * * *

UNITED STATES PATENT AND TRADEMARK OFFICE

CERTIFICATE OF CORRECTION

PATENT NO. : 4,911,212

DATED : March 27, 1990

INVENTOR(S) : JOHN BURTON

It is certified that error appears in the above-identified patent and that said Letters Patent is hereby corrected as shown below:

Column 8, claim 18, line 58, change "proe" to --probe--.

Signed and Sealed this

Ninth Day of April, 1991

*Attest:*

HARRY F. MANBECK, JR.

*Attesting Officer*

*Commissioner of Patents and Trademarks*